US011925210B2

(12) United States Patent
Liu et al.

(10) Patent No.: US 11,925,210 B2
(45) Date of Patent: Mar. 12, 2024

(54) ELECTRIC HEATING DEVICE HAVING AIR CHANNEL

(71) Applicant: CHINA TOBACCO GUANGDONG INDUSTRIAL CO., LTD., Guangdong (CN)

(72) Inventors: Yibo Liu, Guangdong (CN); Feng Li, Guangdong (CN); Jing Hu, Guangdong (CN); Ruifeng Zhao, Guangdong (CN); Zhiyong Xiang, Guangdong (CN)

(73) Assignee: CHINA TOBACCO GUANGDONG INDUSTRIAL CO., LTD., Guangdong (CN)

( * ) Notice: Subject to any disclaimer, the term of this patent is extended or adjusted under 35 U.S.C. 154(b) by 648 days.

(21) Appl. No.: 17/257,306

(22) PCT Filed: Jul. 31, 2018

(86) PCT No.: PCT/CN2018/097758

§ 371 (c)(1),
(2) Date: Dec. 31, 2020

(87) PCT Pub. No.: WO2020/006796

PCT Pub. Date: Jan. 9, 2020

(65) Prior Publication Data

US 2021/0227886 A1 Jul. 29, 2021

(30) Foreign Application Priority Data

Jul. 4, 2018 (CN) ..... 201810723050.0

(51) Int. Cl.

| | |
|---|---|
| ***A24F 40/46*** | (2020.01) |
| ***A24F 40/485*** | (2020.01) |
| ***A24F 40/50*** | (2020.01) |

(52) U.S. Cl.

CPC ..... *A24F 40/46* (2020.01); *A24F 40/50* (2020.01); *A24F 40/485* (2020.01)

(58) Field of Classification Search

CPC ..... A24F 40/46; A24F 40/50; A24F 40/485; A24F 40/20; A24F 40/40; A24F 40/48

See application file for complete search history.

(56) References Cited

U.S. PATENT DOCUMENTS

2017/0367404 A1 12/2017 Li

FOREIGN PATENT DOCUMENTS

CN 206612214 11/2017
CN 206612214 U * 11/2017

(Continued)

OTHER PUBLICATIONS

"International Search Report (Form PCT/ISA/210)"of PCT/CN2018/097758, dated Dec. 6, 2018, pp. 1-4.

*Primary Examiner* — Jean F Duverne
(74) *Attorney, Agent, or Firm* — Samson G. Yu

(57) ABSTRACT

An electric heating device having an air channel includes an upper cover component and a lower shell component. A heater component is arranged in a lower shell of the lower shell component, and includes a heater shell, a heating member and a heating member base arranged in the heater shell. A ventilation portion is arranged at a heating member base to guide an air flow to the heating member, and is matched with a first air inlet on the lower shell and a second air inlet on the heater shell. The air flow is led to the heating member from an outside of the lower shell through the first air inlet, the second air inlet, and the ventilation in sequence.

11 Claims, 8 Drawing Sheets

(56) References Cited

FOREIGN PATENT DOCUMENTS

| | | | | | |
|---|---|---|---|---|---|
| CN | 206923684 | | | 1/2018 | |
| CN | 107713009 | | | 2/2018 | |
| CN | 107713009 | A | * | 2/2018 | ..... A24F 13/00 |
| CN | 108158043 | | | 6/2018 | |
| EP | 3205220 | A1 | | 8/2017 | |
| UA | 116030 | C2 | | 1/2018 | |

* cited by examiner

ELECTRIC HEATING DEVICE HAVING AIR CHANNEL

CROSS-REFERENCE TO RELATED APPLICATION

This application is a 371 of international application of PCT application serial no. PCT/CN2018/097758, filed on Jul. 31, 2018, which claims the priority benefit of China application no. 201810723050.0, filed on Jul. 4, 2018. The entirety of each of the above mentioned patent applications is hereby incorporated by reference herein and made a part of this specification.

BACKGROUND

Technical Field

The present invention relates to the field of electric heating of tobacco products, and more particularly, to an electric heating device having an air channel.

Description of Related Art

Different from a traditional smoking way of intense combustion of lighting cigarette with open flame to intensely burn, a smoking way of baking by electric heating avoids a process of releasing harmful ingredients by pyrolysis because there is no open flame burning, and harmful substances in smoke are much lower than those produced by traditional cigarettes after burning. Therefore, the smoking way of baking by electric heating has become a potential direction for the development of the tobacco industry in the future. Electric heating needs to heat a tobacco product with the help of a heating member, so as to volatilize aroma substances in the tobacco product to obtain a feeling similar to burning and smoking the tobacco product. When the tobacco product is heated, the tobacco product is usually inserted into a cavity of the electric heating device from an open end of a cigarette holder. An air inlet quantity and an air inlet manner have a great influence on a smoking quality. At present, design of an air channel of the electric heating device has the problems that: air supply enters through a gap formed between a cigarette and a heating cavity, and the smoke is released and sucked out through the cigarette. This manner has the disadvantages that the cigarette is loose in the heating cavity, and entry of cold air cannot be controlled, which affects the smoking quality and also has the risk of igniting the cigarette. Another manner is that the air channel is designed between an inner wall and an outer wall of the heating cavity, and the air supply enters a bottom portion of the cavity through a space between the inner and outer walls near the cigarette holder end, and then enters the cigarette through a tobacco shred end portion. This manner has the disadvantages of long path and large sucking resistance. In addition, this structural design leads to troublesome cleaning and use, and has poor user experience. Yet another manner is that the smoke directly enters the heating cavity through the outer wall of the heating cavity, which has the disadvantage that the smoke easily emerges from the air inlet during heating, losses of the smoke and smoke compositions are obvious, and the consumption experience is not good.

SUMMARY

An objective of the present invention is to provide an electric heating device having an air channel, wherein the electric heating device has smooth ventilation, which can effectively ensure air supply and smoke release during baking, and improve smoking quality.

In order to solve the foregoing technical problems, the present invention adopts an electric heating device having an air channel. The electric heating device includes an upper cover component and a lower shell component. The upper cover component includes an upper shell and a guiding tube for inserting a tobacco product therein. The lower shell component includes a lower shell, and a battery, a control element, and a heater component which arranged in the lower shell. The lower shell is detachably connected with the upper shell. The heater component includes a heater shell, a heating member and a heating member base which are arranged in the heater shell. The heating member is arranged on the heating member base. The heating member is connected with the control element. One end of the guiding tube is connected with the upper shell, the other end of the guiding tube extends into the heater shell, and the heating member is at least partially located in the guiding tube. When in use, a cigarette is inserted through the guiding tube at one side of the upper shell until the cigarette is at least flush with an edge at the other side of the guiding tube to contact with the heating member. The heating member base is provided with a ventilation portion to guide an air flow to the heating member. The lower shell is provided with a first air inlet, the heater shell is provided with a second air inlet, and the air flow is led to the heating member from an outside of the lower shell through the first air inlet, the second air inlet, and the ventilation portion in sequence.

According to the electric heating device of the present invention, an air channel of an existing electric heating device is improved, and the ventilation portion is arranged at a position of the heating member base abutted with the guiding tube, and is matched with the first air inlet and the second air inlet to form the air channel with smooth ventilation, so that a smoke release path is separated from an air supply path.

Further, the tobacco product includes, but is not limited to the cigarette.

The guiding tube, the heating member, and the heating member base together form a cigarette heating cavity.

Further, the ventilation portion is arranged at the position of the heating member base abutted with the guiding tube.

Further, the ventilation portion includes at least one groove arranged at a top portion of the heating member base, and a side wall of the heating member base is provided with an opening communicated with the groove. With this design, the air flow enters from the side wall of the heating member base and enters the cigarette heating cavity through the groove.

Furthermore, the groove extends from a contact portion of the heating member and the top portion of the heating member base to the side wall of the heating member base.

Furthermore, the groove includes a circular groove at the contact portion between the heating member and the top portion of the heating member base, and at least one extension groove communicated with the circular groove. The extension groove is communicated with the opening. The circular groove can be more suitable for a shape of the cigarette, which is beneficial to air supply to an inside of the cigarette.

Furthermore, a size of the circular groove is matched with a size of a tobacco section of the tobacco product.

Furthermore, a width of the extension groove gradually decreases along the opening to a direction where the circular groove is located.

Furthermore, the ventilation portion further includes a through hole piece, and the through hole piece is arranged at a contact portion of the groove and the tobacco product. On one hand, the through hole piece can ensure that the smoke can enter the cigarette through the groove, and a size of a hole structure of the through hole piece can be regulated to regulate the smoke quantity. The through hole piece has a porous structure or a mesh structure. A ventilation amount of the through hole piece is regulated correspondingly according to a sucking resistance. The through hole piece may either be non-detachably connected with the groove, or detachably connected with the groove. Moreover, the through hole piece may be used for preventing residues of the tobacco product from falling into the groove, which is convenient for cleaning. The advantage of this design is that the cavity does not need to be cleaned after each use, which simplifies a use procedure of a consumer and improves user experience.

Further, the second air inlet is arranged at a lower portion of a side wall of the heater shell.

Furthermore, a path of the air channel is changed and regulated by setting relative positions of the first air inlet, the second air inlet and the opening. As one of the implementations, the first air inlet is arranged at a middle portion or an upper portion of a side wall of the lower shell. The second air inlet is arranged on a side wall of a lower portion of the heater shell, and a position of the second air inlet corresponds to a lower portion of the side wall of the lower shell. A position of the opening corresponds to the middle portion or the upper portion of the side wall of the lower shell.

Further, an axis of the heating member coincides with an axis of the guiding tube. The heating member is provided with a tip portion so that the heating member can be inserted into the cigarette. Further, the heating member is plate-shaped or rod-shaped, and preferably, the heating member is rod-shaped.

Compared with the prior art, the present invention has the beneficial effects as follows. According to the electric heating device of the present invention, the air channel of the existing electric heating device is improved, and the ventilation portion is arranged at the heating member base, and is matched with the first air inlet and the second air inlet to form the air channel with smooth ventilation, so that the smoke release path is separated from the air supply path, thereby ensuring efficient air supply and smoke release during baking, and accordingly improving smoking quality.

DESCRIPTION OF THE EMBODIMENTS

Figure 1:
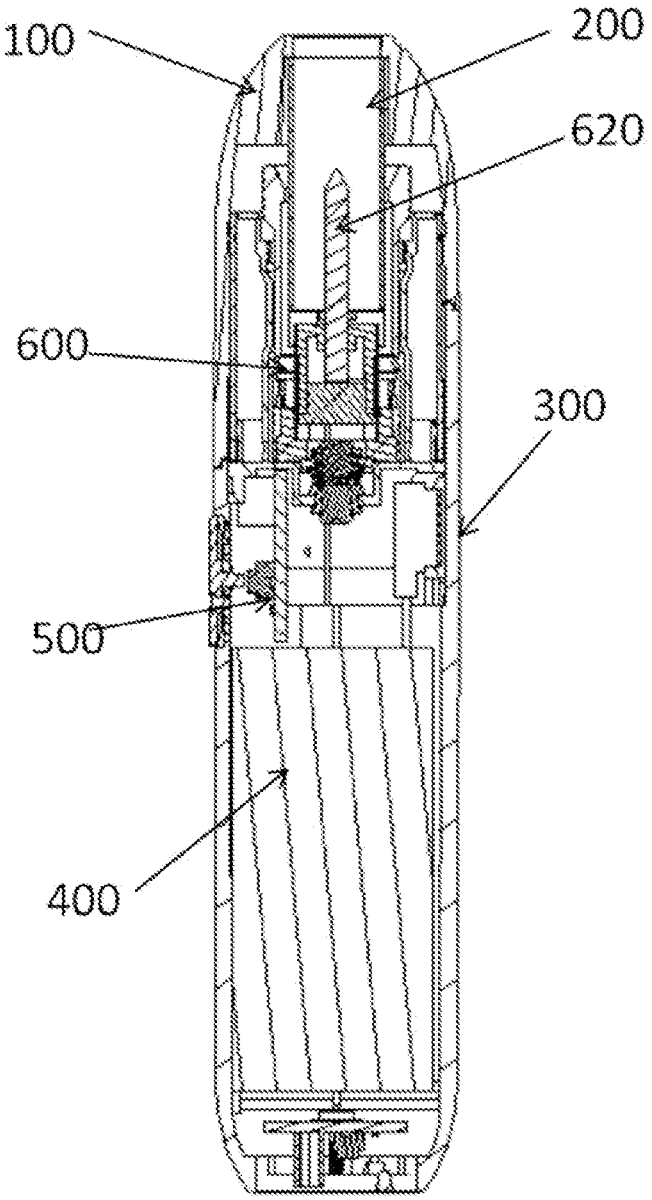
FIG. 1 is a schematic sectional view of a structure of an electric heating device according to the present invention.
Figure 2:
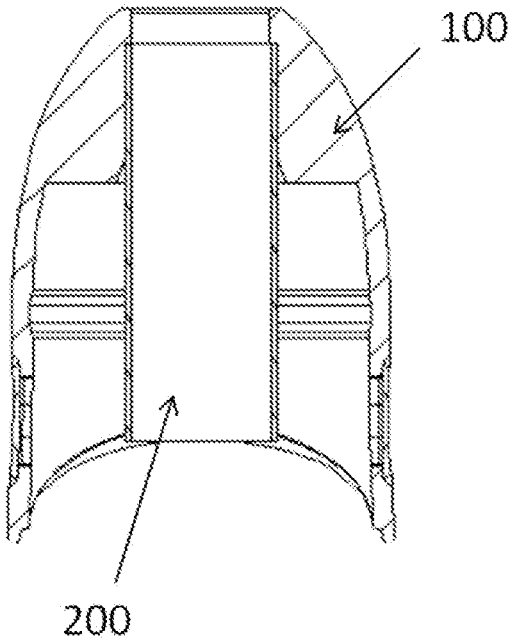
FIG. 2 is a schematic sectional view of an upper cover component.
Figure 3:
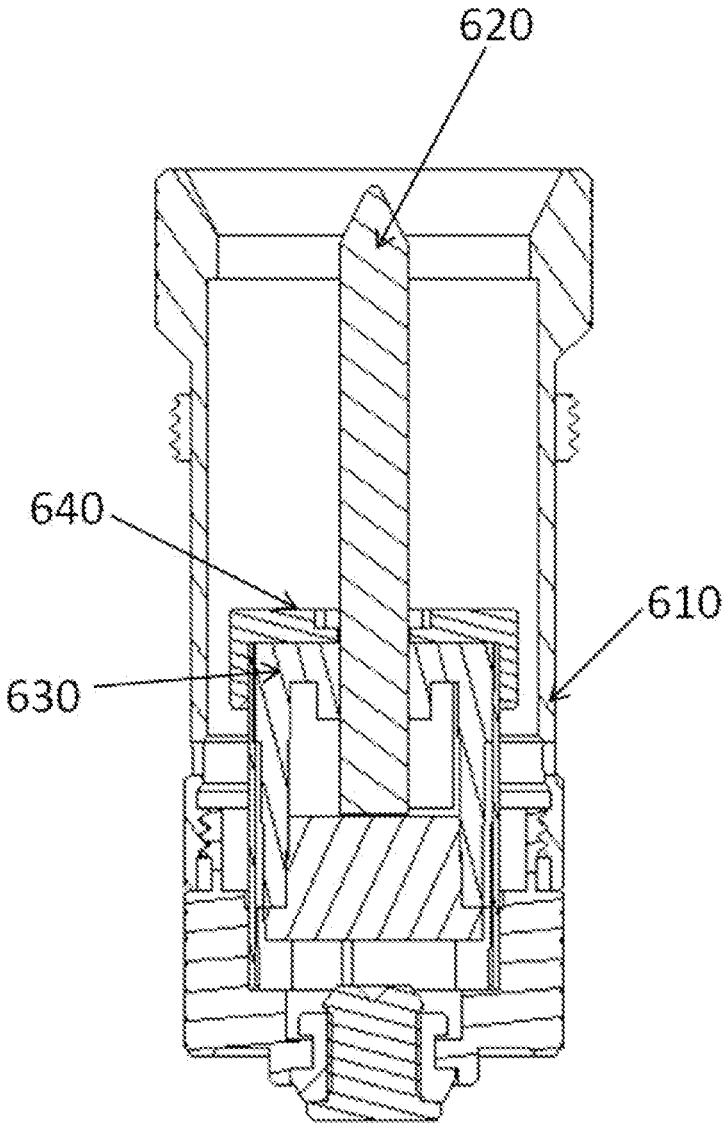
FIG. 3 is a schematic sectional view of a heater component.
Figure 4:
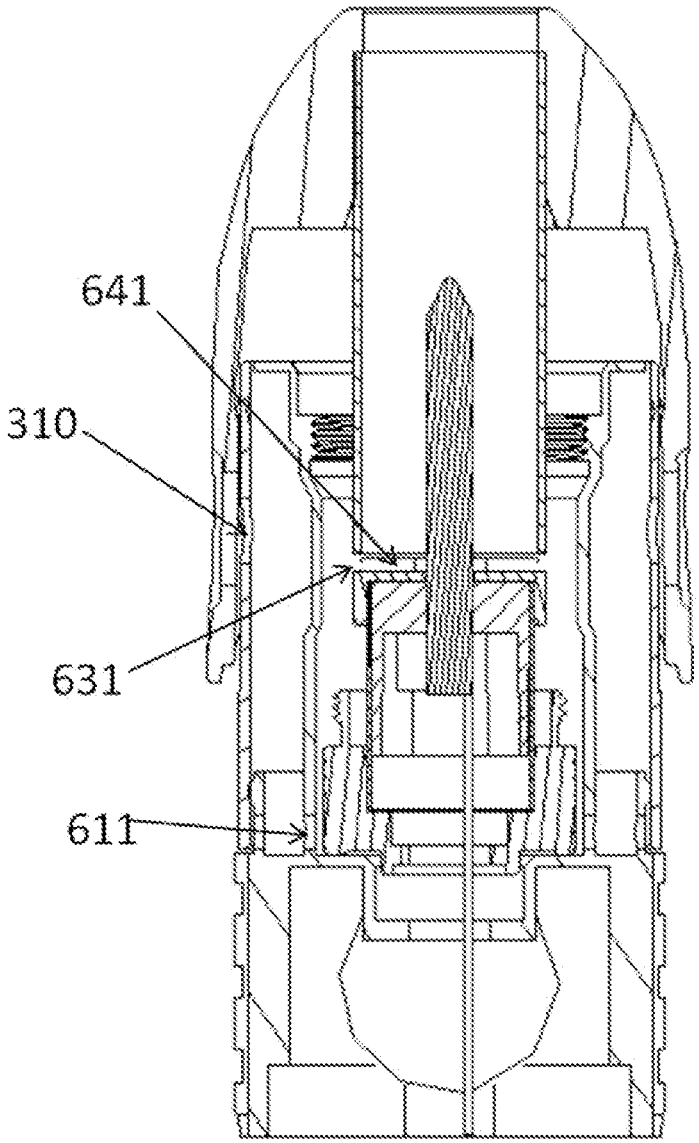
FIG. 4 is a schematic sectional view of a combination of the upper cover component and the heater component.

The present invention will be further described in detail below with reference to specific implementations.

The same or similar reference numerals in the accompanying drawings of the embodiments of the present invention correspond to the same or similar components. In the description of the present invention, it should be understood that the orientation or positional relationship indicated by the terms "upper", "lower", "left", "right", "top", "bottom", "inside" and "outside" is based on the orientation or positional relationship shown in the drawings, and it is only for the convenience of describing the present invention and simplifying the description, but does not indicate or imply that the indicated device or element must have a specific orientation, and be constructed and operated in a specific orientation. Therefore, the terms describing the positional relationship in the drawings are only for exemplary explanation and should not be understood as limiting the patent.

In addition, if the terms "first" and "second" are only used for description purposes, the terms are mainly used to distinguish different devices, elements or components (the specific types and structures may be the same or different), but are not used to indicate or imply the relative significance and quantity of the indicated devices, elements or components, and cannot be understood as indicating or implying the relative significance.

Embodiment 1

As shown in FIGS. 1 to 5, an electric heating device having an air channel includes an upper cover component and a lower shell component. The upper cover component includes an upper shell 100 and a guiding tube 200 for inserting a cigarette therein. The lower shell component includes a lower shell 300, and a battery 400, and a control element 500, and a heater component 600 which are arranged in the lower shell 300. The lower shell 300 is detachably connected with the upper shell 100.

The heater component 600 includes a heater shell 610, and a heating member 620 and a heating member base 630 which are arranged in the heater shell 610. The heating member 620 is arranged on the heating member base 630, and the heating member 620 is connected with the control element 500 through a wire. An axis of the heating member 620 coincides with an axis of the guiding tube 200. The heating member 620 is provided with a tip portion so that the heating member can be inserted into the cigarette.

One end of the guiding tube 200 is connected with the upper shell 100, the other end of the guiding tube 200 extends into the heater shell 610, and the heating member 620 is at least partially located in the guiding tube 200. The guiding tube 200, the heating member 620, and the heating member base 630 together form a cigarette heating cavity.

The heating member base 630 is provided with a ventilation portion 640 to guide an air flow to the heating member. The lower shell 300 is provided with a first air inlet 310, the heater shell 610 is provided with a second air inlet 611, and the air flow is led to the heating member 620 from an outside of the lower shell through the first air inlet 310, the second air inlet 611, and the ventilation portion in sequence.

Figure 6:
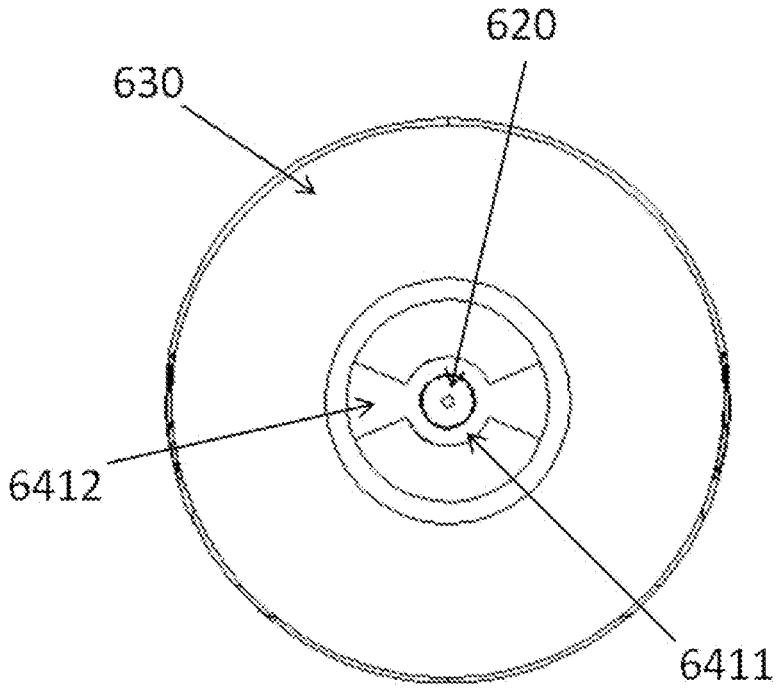
FIG. 6 is a schematic sectional view of a ventilation portion (one groove).
Figure 7:
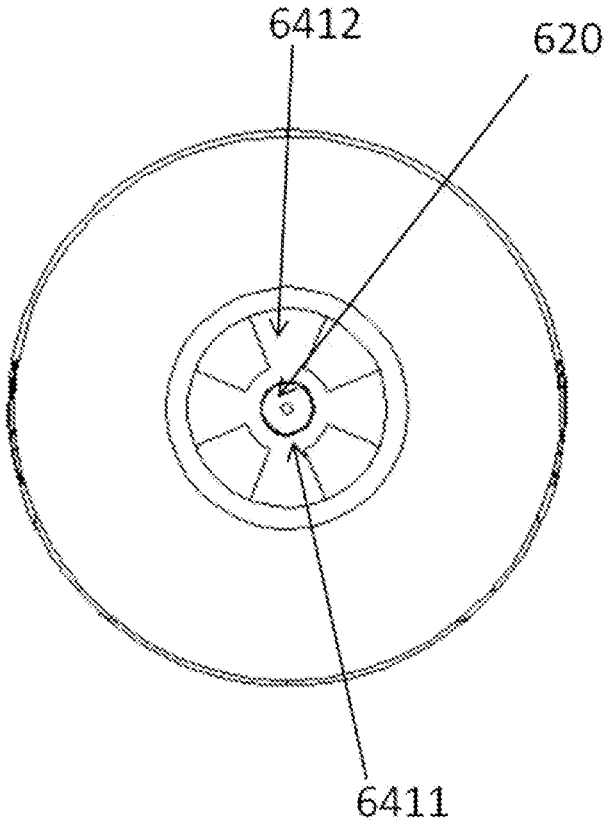
FIG. 7 is a schematic sectional view of the ventilation portion (a plurality of grooves).

The ventilation portion 640 includes at least one groove 641 arranged on a top portion of the heating member base 630. As shown in FIGS. 6 to 7, one or more grooves 641 may be provided. If one groove is provided, the groove may be a through groove; and if a plurality of grooves are is provided, the plurality of grooves are arranged along a radial direction of the cigarette. A side wall of the heating member base 630 is provided with an opening 631 communicated with the groove. The air flow enters from the side wall of the heating member base, and enters the cigarette heating cavity through the groove.

The groove 641 may have various shapes. In this embodiment, preferably, the groove 641 includes a circular groove 6411 at a contact portion of the heating member and a top portion of the heating member base 630, and at least one extension groove 6412 communicated with the circular groove 6411. The extension groove 6412 is communicated with the opening. A size of the circular groove 6411 is matched with a size of a tobacco section of the tobacco product. The circular groove 6411 can be more suitable for a shape of the cigarette, which is beneficial to air supply to an inside of the cigarette. A width of the extension groove 6412 gradually decreases along the opening to a direction where the circular groove 6411 is located.

Figure 5:
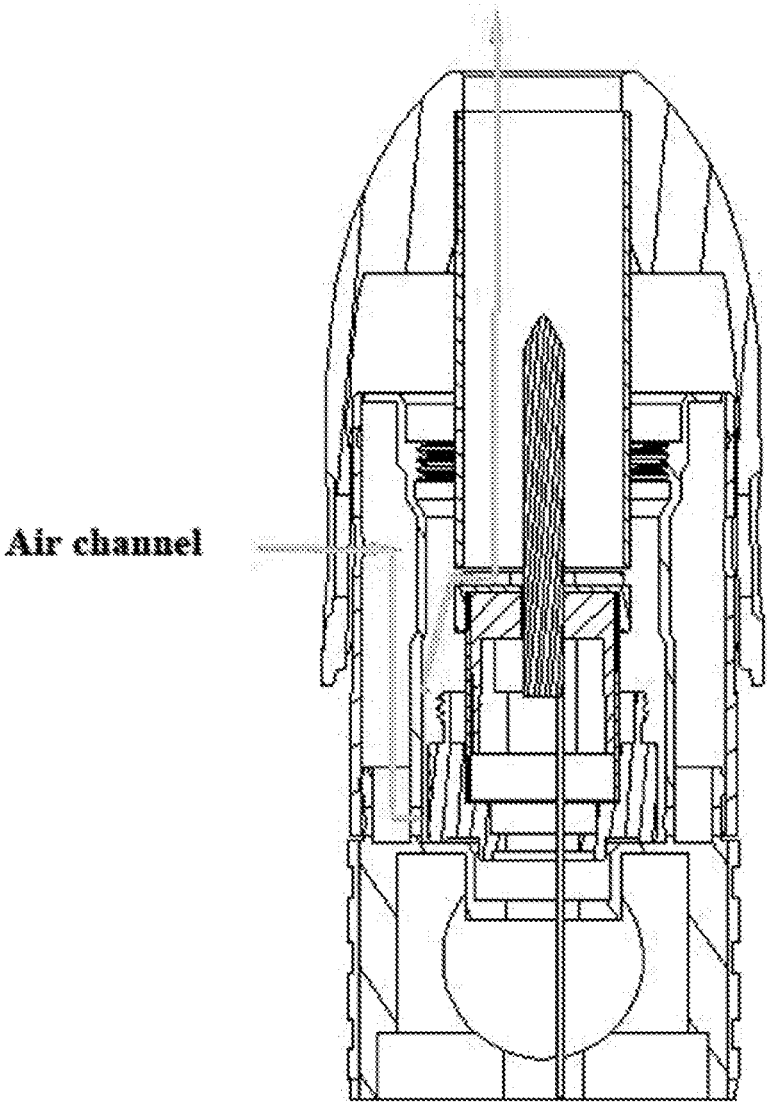
FIG. 5 is a schematic diagram of an air channel for air supply during smoking.

In this embodiment, the first air inlet 310 is arranged at a middle portion or an upper portion of a side wall of the lower shell. The second air inlet 611 is arranged on a side wall of a lower portion of the heater shell 610, and a position of the second air inlet corresponds to the lower portion of the side wall of the lower shell 300. A position of the opening corresponds to the middle portion or the upper portion of the side wall of the lower shell 300. An air channel for air supply is shown in FIG. 5.

Embodiment 2

Figure 8:
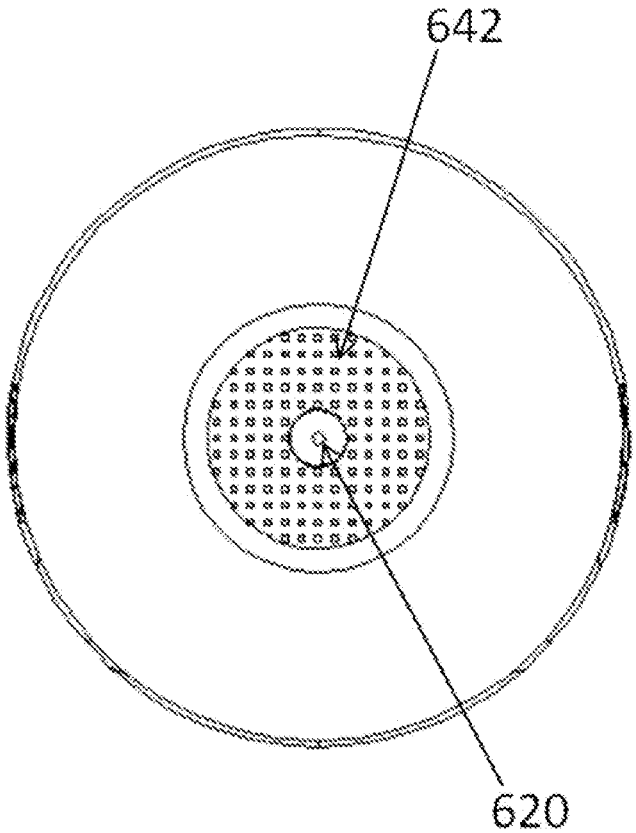
FIG. 8 is a schematic sectional view of a junction of the ventilation portion and a through hole piece.

This embodiment is a second embodiment of the present invention. Different from Embodiment 1, in this embodiment, as shown in FIG. 8, the ventilation portion 640 further includes a through hole piece 642, which is arranged at a contact portion of the groove and the cigarette. The through hole piece 642 may either be fixed to or separable from the groove. The through hole piece 642 has a porous structure or a mesh structure. A ventilation amount of the through hole piece 642 is regulated correspondingly according to a sucking resistance, and the through hole piece 642 may be used for preventing residues of the tobacco product from falling into the groove, which is convenient for cleaning.

Other members and connection methods are the same as those in Embodiment 1.

Obviously, the above-mentioned embodiments of the present invention are merely examples for clearly illustrating the present invention, but are not intended to limit the implementations of the present invention. For those of ordinary skills in the art, other different forms of changes or variations can be made on the basis of the above description. It is not necessary or possible to exhaust all the implementations here. Any modifications, equivalent substitutions, and improvements made within the spirit and principle of the present invention shall all fall within the scope of protection claimed by the present invention.

What is claimed is:

1. An electric heating device having an air channel, the electric heating device comprising an upper cover component and a lower shell component; wherein the upper cover component comprises an upper shell and a guiding tube for inserting a tobacco product therein;

the lower shell component comprises a lower shell, and a battery, a control element, and a heater component which are arranged in the lower shell; and the lower shell is detachably connected with the upper shell;

the heater component comprises a heater shell, a heating member and a heating member base which are arranged in the heater shell; the heating member is arranged on the heating member base; and the heating member is connected with the control element;

one end of the guiding tube is connected with the upper shell, the other end of the guiding tube extends into the heater shell, and the heating member is at least partially located in the guiding tube; and the heating member base is provided with a ventilation portion to guide an air flow to the heating member; the lower shell is provided with a first air inlet, the heater shell is provided with a second air inlet, and the air flow is led to the heating member from an outside of the lower shell through the first air inlet, the second air inlet, and the ventilation portion in sequence, wherein the ventilation portion comprises at least one groove arranged at a top portion of the heating member base, and a side wall of the heating member base is provided with an opening communicated with the groove.

2. The electric heating device according to claim 1, wherein the groove extends from a contact of the heating member and the top portion of the heating member base to the side wall of the heating member base.

3. The electric heating device according to claim 1, wherein the groove comprises a circular groove at the contact of the heating member and the top portion of the heating member base, and at least one extension groove communicated with the circular groove; and the extension groove is communicated with the opening.

4. The electric heating device according to claim 1, wherein the ventilation portion further comprises a through hole piece, and the through hole piece is arranged at a contact of the groove and the tobacco product.

5. The electric heating device according to claim 4, wherein the through hole piece has a porous structure or a mesh structure.

6. The electric heating device according to claim 4, wherein the through hole piece is non-detachably connected with the heating member base.

7. The electric heating device according to claim 4, wherein the through hole piece is detachably connected with the heating member base.

8. The electric heating device according to claim 1, wherein the second air inlet is arranged at a lower portion of a side wall of the heater shell.

9. The electric heating device according to claim 1, wherein the first air inlet is arranged at a middle portion or an upper portion of a side wall of the lower shell; the second air inlet is arranged on a side wall of a lower portion of the heater shell, and a position of the second air inlet corresponds to the lower portion of the side wall of the lower shell; and a position of the opening corresponds to the middle portion or the upper portion of the side wall of the lower shell.

10. The electric heating device according to claim 2, wherein the ventilation portion further comprises a through hole piece, and the through hole piece is arranged at a contact of the groove and the tobacco product.

11. The electric heating device according to claim 3, wherein the ventilation portion further comprises a through hole piece, and the through hole piece is arranged at a contact of the groove and the tobacco product.

* * * * *